US010520252B2

(12) United States Patent
Momen et al.

(10) Patent No.: US 10,520,252 B2
(45) Date of Patent: Dec. 31, 2019

(54) DRYER USING HIGH FREQUENCY VIBRATION

(71) Applicant: UT Battelle, LLC, Oak Ridge, TN (US)

(72) Inventors: Ayyoub Mehdizadeh Momen, Knoxville, TN (US); Kyle R. Gluesenkamp, Knoxville, TN (US); Edward Allan Vineyard, Knoxville, TN (US); Roger A. Kisner, Knoxville, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 194 days.

(21) Appl. No.: 15/798,057

(22) Filed: Oct. 30, 2017

(65) Prior Publication Data

US 2018/0142951 A1 May 24, 2018

Related U.S. Application Data

(63) Continuation of application No. PCT/US2016/030885, filed on May 5, 2016.

(Continued)

(51) Int. Cl.
*F26B 5/02* (2006.01)
*D06F 58/02* (2006.01)

(Continued)

(52) U.S. Cl.
CPC ..... *F26B 5/02* (2013.01); *D06F 58/02* (2013.01); *D06F 58/20* (2013.01); *D06F 58/28* (2013.01)

(58) Field of Classification Search
CPC . F26B 5/02; D06F 58/02; D06F 58/20; D06F 58/28

(Continued)

(56) References Cited

U.S. PATENT DOCUMENTS 3,694,926 A 10/1972 Rodwin et al.
5,842,288 A * 12/1998 Laseke ..... D06F 58/28 34/524

(Continued)

FOREIGN PATENT DOCUMENTS

CN 104294527 A 1/2015
EP 1 860 227 A1 11/2007

(Continued)

OTHER PUBLICATIONS

International Preliminary Report on Patentability and Written Opinion of the International Searching Authority related to International Application No. PCT/US2016/030885 dated Nov. 14, 2017, 9 pages.

(Continued)

*Primary Examiner* — Stephen M Gravini
(74) *Attorney, Agent, or Firm* — Benesch, Friedlander, Coplan & Aronoff LLP

(57) ABSTRACT

A dryer includes a plurality of piezoelectric transducers in electrical communication with a high frequency piezoelectric oscillation generator. The piezoelectric oscillation generator controls the duty cycle and resonant frequency source signal that drive the plurality of piezoelectric transducers non-continuously. The piezoelectric transducers dry the wet articles without heating air passing through the articles.

23 Claims, 15 Drawing Sheets

Related U.S. Application Data

(60) Provisional application No. 62/158,562, filed on May 8, 2015.

(51) Int. Cl.
*D06F 58/28* (2006.01)
*D06F 58/20* (2006.01)

(58) Field of Classification Search
USPC ..... 34/401
See application file for complete search history.

(56) References Cited

U.S. PATENT DOCUMENTS

| | | | | |
|---|---|---|---|---|
| 5,906,056 | A * | 5/1999 | Noguchi | D06F 37/225 34/596 |
| 7,946,057 | B2 * | 5/2011 | Dittmer | D06F 58/20 34/597 |
| 7,958,650 | B2 * | 6/2011 | Turatti | F26B 25/002 15/3.2 |
| 8,042,282 | B2 * | 10/2011 | Oh | D06F 58/04 126/299 D |
| 9,290,885 | B2 * | 3/2016 | Kim | D06F 58/26 |
| 9,353,471 | B2 * | 5/2016 | Choi | D06F 37/225 |
| 2018/0142951 | A1 * | 5/2018 | Momen | D06F 58/02 |
| 2019/0062985 | A1 * | 2/2019 | Christensen | D06F 25/00 |
| 2019/0072327 | A1 * | 3/2019 | Kisner | F26B 5/02 |

FOREIGN PATENT DOCUMENTS

| | | | | |
|---|---|---|---|---|
| EP | 2 146 001 | A1 | 1/2010 | |
| EP | 2 827 087 | A1 | 1/2015 | |
| GB | 2 057 655 | A | 4/1981 | |
| WO | WO 91/01473 | | 2/1991 | |
| WO | WO-2016182832 | A1 * | 11/2016 | D06F 58/02 |

OTHER PUBLICATIONS

International Search Report related to International Application No. PCT/US2016/030885 dated Jun. 22, 2016, 3 pages.

* cited by examiner

DRYER USING HIGH FREQUENCY VIBRATION

PRIORITY CLAIM

This application is a continuation of International Application No. PCT/US2016/030885 and claims priority to U.S. Provisional Patent Application No. 62/158,562, filed May 8, 2015, titled "Clothes Dryer Using Ultrasound Phenomena", both of which are herein incorporated by reference.

STATEMENT REGARDING FEDERALLY SPONSORED RESEARCH AND DEVELOPMENT

This invention was made with United States government support under Contract No. DE-AC05-00OR22725 awarded by the United States Department of Energy. The United States government has certain rights in the invention.

BACKGROUND

Technical Field

This disclosure relates to high frequency drying and more specifically to systems and processes that improve drying efficiency.

Related Art

Conventional clothes dryers use an energy source such as natural gas or electricity to dry clothes. A gas or electric heater heats air that passes through the clothes as they tumble and turn. Moisture is removed from the clothes via the heated air by converting the water retained in the clothes into vapor, which requires a substantial amount of continuous energy. The heat that dries the clothes is then removed and exhausted from the dryer.

Besides the inefficiency and the cost of converting cold air into hot air, water into vapor, and venting hot wet air, conventional clothes dryers also pose safety hazards. When the temperature exceeds a safe operating threshold, the dryers can overheat, damaging the clothes, the dryer, and the structures near them. Such failures can occur when airflow is restricted or when a dryer's thermal cutoff switch fails. There is a need for a system and process that provides a more efficient, less expensive, and a safer process to dry clothes. A technical challenge addressed by this disclosure is that of improving the efficiency of the drying process so that it may be used safely in vented and ventless systems.

DETAILED DESCRIPTION OF THE PREFERRED EMBODIMENTS

Figure 1:
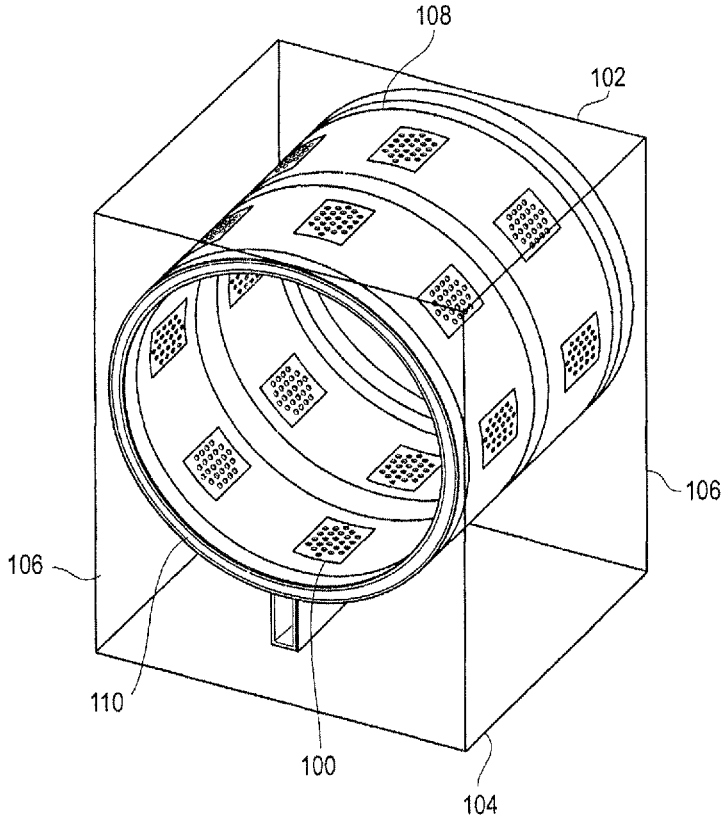
FIG. 1 is a dryer with mist collectors that overlie piezoelectric mesh transducers.

The disclosed high frequency technology is clean, efficient, and environmentally friendly. The collection of systems and processes disclosed are herein referred to as "the systems". The systems may be adapted to existing dryers including blower and lint filter dryers, drum shroud dryers, and integrated drum shroud dryers. The systems may also be adapted to new innovative dryer designs including wringer type dryers and sandwich press/iron dryers. The innovation overcomes technical problems in the clothing industry, paper industry, food industry, mining industry, environmental industry, and in chemical manufacture, to name a few. It is used in stand-alone systems and large-scale enterprise systems. The systems' high frequency mesh transducers convert electrical signals into high frequency mechanical waves. They also convert ultrasound and mechanical waves into electrical signals when not powered by electrical signals. The technology makes use of high frequency transceivers that both (a) sense pressure and high frequency signals and (b) transmit pressure and high frequency signals. High frequency signals include ultrasonic signals that generate waves having a frequency above twenty thousand cycles per second.

One or more high frequency generators (also known as a high frequency controller, controller, amplifier, driving power driver, or drive controller) control the duty cycle and resonant frequencies that drive the high frequency transducers/transceivers (herein referred to as high frequency piezoelectric transducers). A drying effect is achieved by vibrating an article through piezoelectric and substrate elements and one, two, or three or more separate meshes within about a 100 Hz to 400 kHz range with a preferable irradiation frequency of about 130 kHz. Other frequencies for irradiation are also possible including about 50 kHz to about 90 kHz, about 100 kHz to about 1 MHz and about 500 kHz to about 2 MHz. The separate spaced apart meshes comprise a plurality of distinct mechanically actuated grids formed by the intersection of wires, polyester lines, or nylon lines, (or a combination) for example; where each mesh is flexible and capable of independent movement. The high frequency transducers/transceivers are driven at a duty cycle within a range of substantially 1% to substantially 30% or more. The transducer duty cycle may be varied throughout the clothes drying cycle process as a function of moisture level. Higher duty cycles are possible including about 40% or about 50%, and up to about 90% approaching 100%. During a drying process, capillary waves form on the surface of liquid retained in an article. The wavelength of the capillary waves depends on the irradiation frequency of the high frequency transducers/transceivers. When oscillated with sufficient intensity (amplitude), the water pinches off into droplets that pass through the spaced apart meshes that partially overlay an open inner annular area bounded by the piezoelectric and substrate elements and passes through a cylindrical shroud outlet. The water then passes through collector channels that terminate at a reservoir or a drain. Unlike conventional dryers that rely on heat energy to evaporate fluid retained by an article into vapor, the disclosed high frequency transducers use mechanical energy and vibrational energy. The term article in this disclosure refers to the object being dried such as a fabric.

Figure 2:
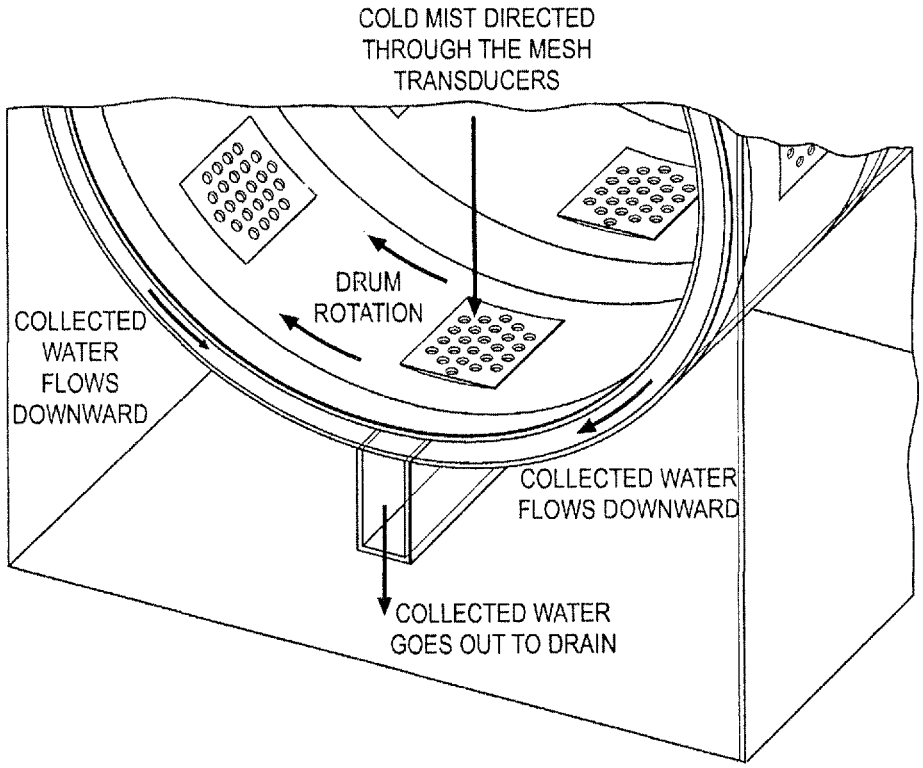
FIG. 2 is a close up view of the mist collectors overlaid on piezoelectric mesh transducers, and the collector channels of FIG. 1.

FIGS. 1 and 2 illustrate dryers. The dryers have a substantially rectangular shape and have a top 102, a bottom 104, a front (not shown), a rear (not shown), and two opposing sides 106. The dryers include a substantially hollow rotary tumbler drum 108 wherein a user places articles such as clothes prior to activating the dryer. The dryer may be in electrical communication with an optional dryer timer (not shown). The timer is activated upon activation of the dryer.

In FIGS. 1 and 2 a plurality of mist collectors overlies piezoelectric high frequency mesh transducers 100 (one piezoelectric high frequency mesh transducer is labeled in FIG. 1) in the hollow rotary tumbler drum 108. In some systems, mist collectors are not used. Instead, only the piezoelectric high frequency mesh transducers 100 (hereinafter referred to as high frequency mesh transducers 100) are used and like the mist collectors they are a unitary portion of a rotary tumbler drum 108. In FIGS. 1 and 2, the concave surfaces of the high frequency mesh transducers 100 come in contact with the articles as the articles tumble within the rotary tumbler drum 108. When contact occurs some high frequency mesh transducers 100 alert an high frequency generator by generating and transmitting a voltage proportional to the force that is applied by the articles to the high frequency mesh transducers 100 (a.k.a. the feedback signal). Once the feedback signal is detected at the high frequency generator via an electrical/data bus or monitoring line, the high frequency generator powers up the high frequency mesh transducers 100 that transmitted the alert which cause the transducers' mesh surfaces to vibrate at a resonant frequency. The vibration causes the radial outward ejection of liquid droplets from the article through the high frequency mesh transducers 100 through the open inner annular area bounded by the piezoelectric and substrate elements. The curved shape of the high frequency mesh transducer surfaces cause the irradiated liquid to coalesce in the annular space and flow downward through the piezoelectric and substrate elements into the collector channels 110 through the aide of gravity, and when the hollow rotary tumbler drum 108 is rotating, through centrifugal force induced by rotation. The liquid that passes through the high frequency mesh transducers 100 are collected in a reservoir or pass through to a drain. In these systems, the drying process occurs only when there is direct contact between one or more articles and the high frequency mesh transducers 100.

Figure 3:
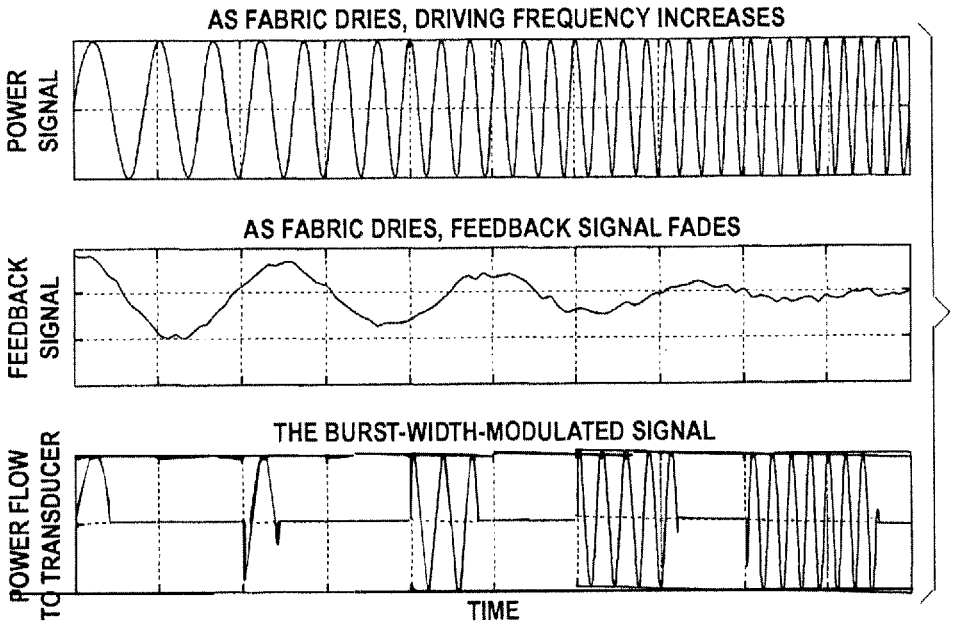
FIG. 3 shows the schematic of the original power signal, the modulation signal, and the resultant power supplied to the piezoelectric mesh transducers.
Figure 4:
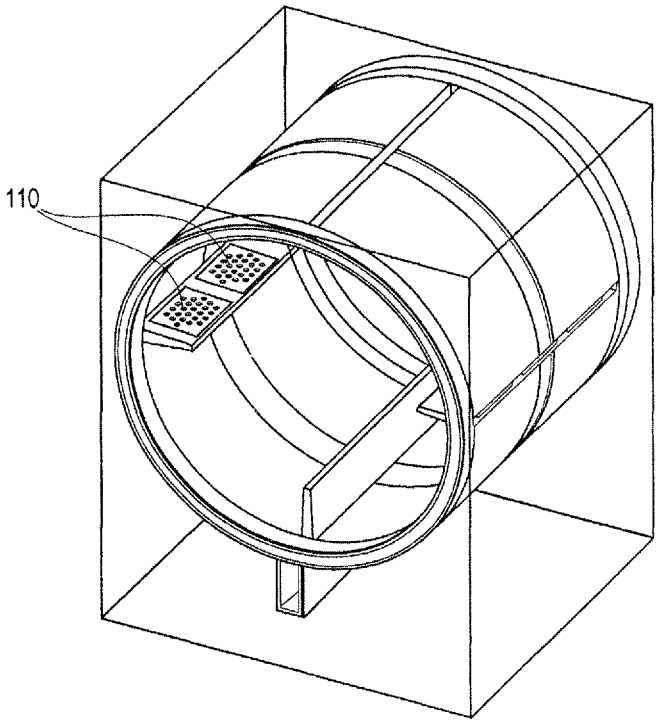
FIGS. 4 and 5 are close up views of the collector channels.
Figure 5:
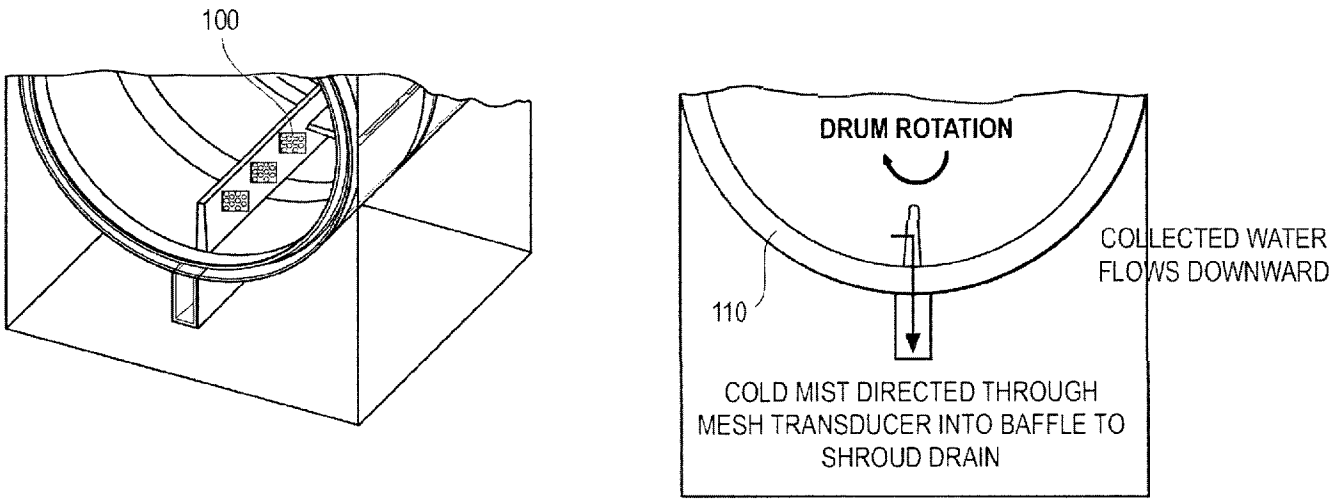

In some alternative systems the duty cycles of the actuated high frequency mesh transducers 100 are determined by the rotational rate of the hollow rotary tumbler drum 108 and the proportional feedback signal generated by the force that is applied by the articles against the high frequency mesh transducers 100. In these alternative systems, as the articles dry the weight of the articles and the proportional feedback voltage signals generated by the high frequency mesh transducers 100 decrease. In turn, this causes the burst-width modulated signal delivered by the high frequency generators to increase. Notably, the power consumed by some high frequency systems is inversely related to the level of moisture retained in the articles or the article's weight and may be used to calibrate the high frequency generator when the articles are first loaded within the rotary tumbler drum 108. In operation, when articles are initially loaded, high frequency generators drive the high frequency mesh transducers 100 at their resonant operating efficiency based on the detected moisture or weight. As the articles eject the liquid or a predetermined amount of the liquid, some high frequency generators proportionally increase the power sourced to the high frequency mesh transducers 100 by increasing the duty cycle sourcing the high frequency mesh transducers 100 as shown in FIG. 3 until the feedback signal falls or fades below a predetermined threshold that is determined from empirical evidence. When the level of the feedback signal falls below the threshold, the high frequency generator shuts off the high frequency mesh transducers 100 completely and in some systems the rotation of the hollow rotary tumbler drum 108 and/or dryer. The system shut down may prevent the over drying of articles, which causes the majority of damage to fabric coming out of conventional dryers. Some or all of the systems may draw in or inject hot air into the hollow rotary tumbler drum 108 to complete the drying process or when the drying period ends to provide warm articles before the dryer shuts down. When fabric is cooler coming out of a dryer, some users incorrectly assume that the articles are still wet and require more drying even when most of the moisture that was in the fabric had been extracted. The addition of hot air at the end of the drying cycle merely enhances the operator experience of unloading the articles from the dryer.

While each of the systems described in this disclosure are shown in vent-less systems, other systems incorporate the high frequency technology in vented systems. For example, when retrofitted to a conventional blower lint filter dryer, the high frequency systems may alternatively or additionally couple a lint filter that overlies an array of high frequency transducers or high frequency mesh transducers 100 that include a series of meshes serially aligned, stacked, and spaced apart in an array. When the liquid droplet sizes in the irradiated mist are of appropriate size, they are entrained in the airflow and transported out of the hollow rotary tumbler drum 108 through the lint filter and other meshes serially stacked and aligned that make up part of the high frequency mesh transducers 100. The liquid droplets coalesce into larger droplets that are then collected in collector channel 110 that terminates at a reservoir or passes to a drain and the dehumidified airflow is exhausted through a vent. In FIGS. 1, 2, 4, and 5 the collector channel 110 is annular shaped and concentric with a portion of the hollow rotary tumbler drum 108 and terminates in a reservoir shown as a collector. In this system the lint filter is multi-functional element as it catches the dust and lint discarded from the article during the drying process and further dehumidifies substantially all of the moisture ejected from the article suspended in the air. Further, the connection between the lint filter and the high frequency mesh transducers 100 is not limited to a mechanical or physical coupling; rather it is a connection that may include intervening parts to the extent they do not substantially impeded air flow intended to pass through the lint filter and high frequency mesh transducers 100 and a vent during operation of the dryer.

While the number of meshes, opening size, and materials used to manufacture the meshes used in the high frequency mesh transducers 100 depend on the application and the type of liquid being extracted from an article, polyester mesh with opening size of about 0.84×0.84 mm are effective when operating in environmental conditions common to consumer clothes dryers. The opening size of the mesh is similar to that of a lint filter and the optimum number of spaced apart, directly adjoining meshes stacked in series (overlying each other above the piezoelectric and substrate elements spaced apart by only by a flat ring made of metal or plastic such as O-rings) is three, which results in a moisture collection efficiency of about 50%. As additional meshes are added in series the cumulative airflow pressure drops along with the moisture collection efficiency.

Because drying occurs when direct contact occurs between an article and one of the mesh layers of the high frequency mesh transducers 100, the high frequency mesh transducers 100 are not activated or powered-up continuously resulting in an energy consumption that is between two to five times less than the energy consumed by conventional dryers. In operation, when the high frequency mesh transducers 100 are activated, the high frequency mesh transducers 100 push the article upward away from the high frequency mesh transducers 100. When contact is lost, power is not sourced to the high frequency mesh transducers 100, meaning that the power is delivered only in bursts when contact occurs between the article and the high frequency mesh transducers 100. After a finite amount of time, the article falls back into contact with the high frequency mesh transducers 100 due to gravity, and in some cases centrifugal force. While direct contract with the high frequency mesh transducers 100 reoccurs, detection occurs when the articles mechanically stress the high frequency mesh transducers 100. In other systems passive sensors such as passive infrared sensors detect direct contact between the articles and the high frequency mesh transducers 100. The term passive in this instance refers to the fact that sensors do not generate or radiate any energy during the detection process.

The energy consumed per unit mass of water is calculated as:

$$\text{Energy per Unit Mass} = \frac{\text{Drying Time} \times \text{Duty Cycle} \times \text{Rated Power of Transducer}}{\text{Mass of Water}}$$

When applying different duty cycles and frequencies, exemplary high frequency mesh transducers 100 which typically operate at resonance frequency of 130 kHz and modulated by modulation frequency of about 600 Hz at about a 60% duty cycle. The minimum energy consumption per unit mass of water is about 0.198 kWh/kg, which is about half the energy consumed when the high frequency mesh transducers 100 were powered up continuously. This is about $1/5^{th}$ of the energy that is used in the conventional electric dryers.

Figure 6:
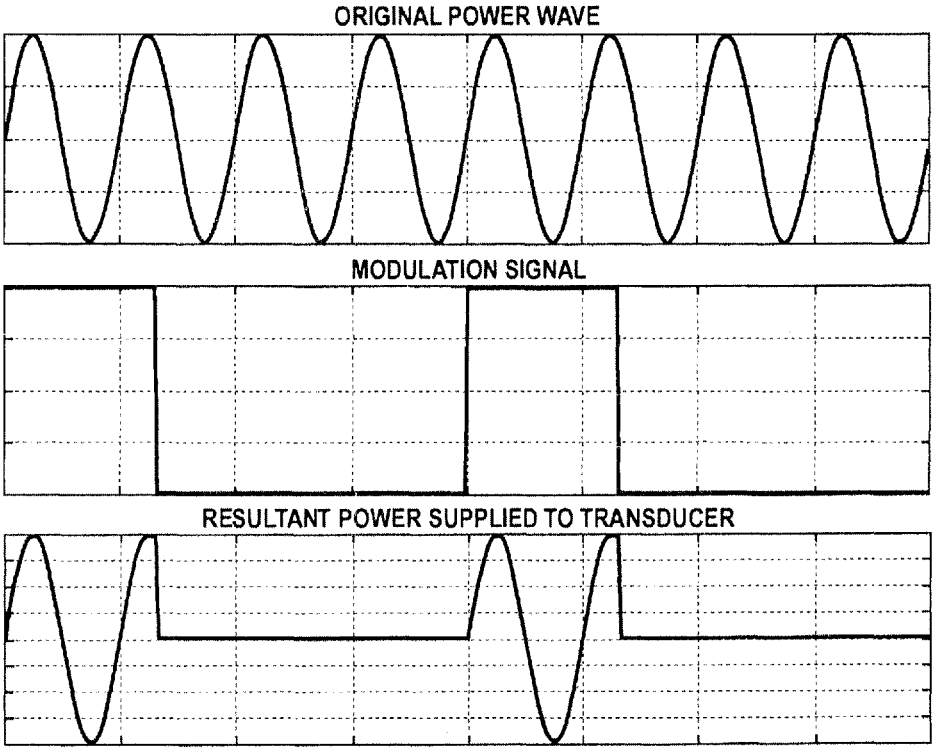
FIG. 6 shows the original power signal, the modulation signal, and the resultant power supplied to the high frequency mesh transducers.

In FIG. 6, high frequency generators supply power to the high frequency mesh transducers 100 through a binary modulated signal. Power is supplied only when the modulating signal is active (high). The resulting mixing of the power wave and the modulated signal renders the power supplied to the high frequency mesh transducers 100. As explained, in some alternative systems the modulation signal may vary with the rate of rotation of the hollow rotary tumbler drum 108 when the hollow rotary tumbler drum 108 is used and contact is detected between an article and one or more high frequency mesh transducers 100. In other alternative systems the duty cycle of the modulation signal varies with the amount of mechanical stress that occurs in the high frequency mesh transducers 100 that may be detected by the proportional voltage generated by the high frequency mesh transducers 100 that is monitored by the high frequency generators.

Figure 7:
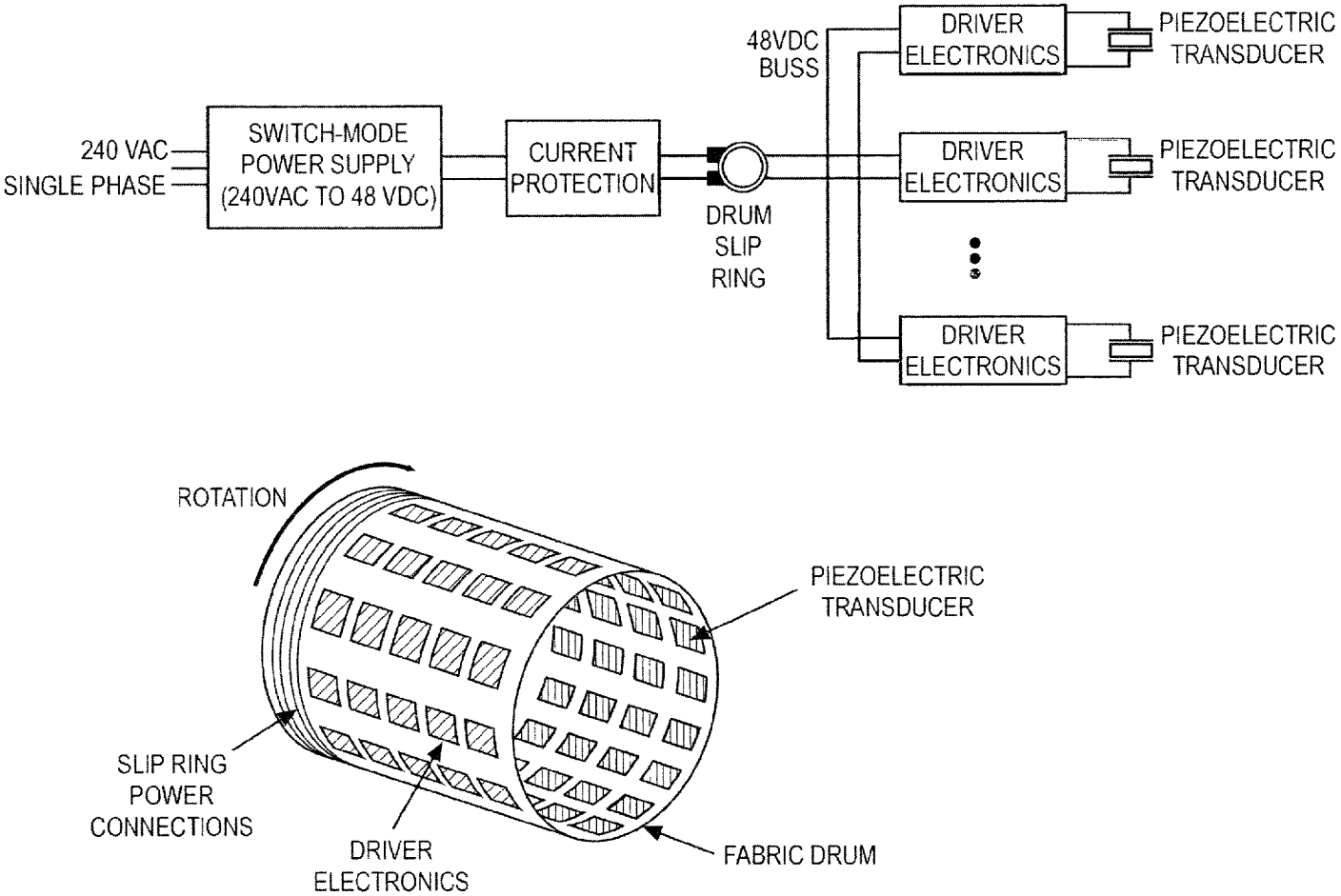
FIG. 7 shows a slip ring power connection to a rotary tumbler drum.
Figure 8:
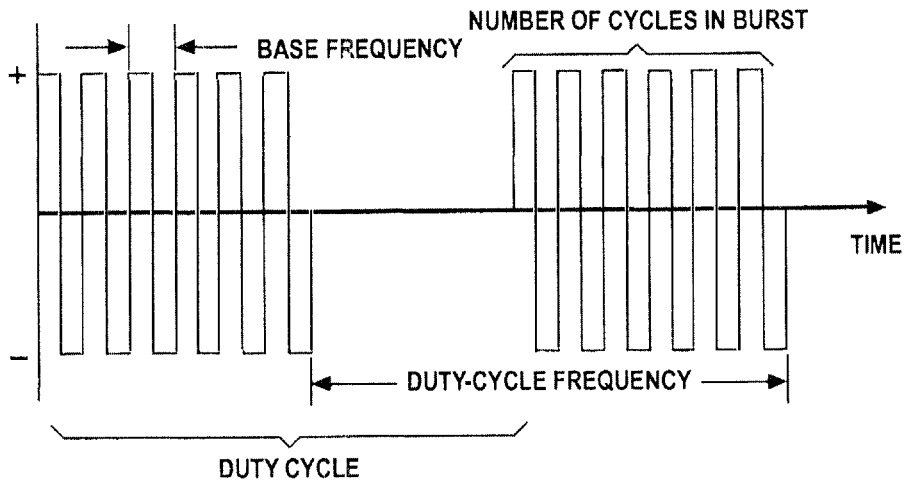
FIG. 8 shows a bipolar burst modulation.
Figure 9:
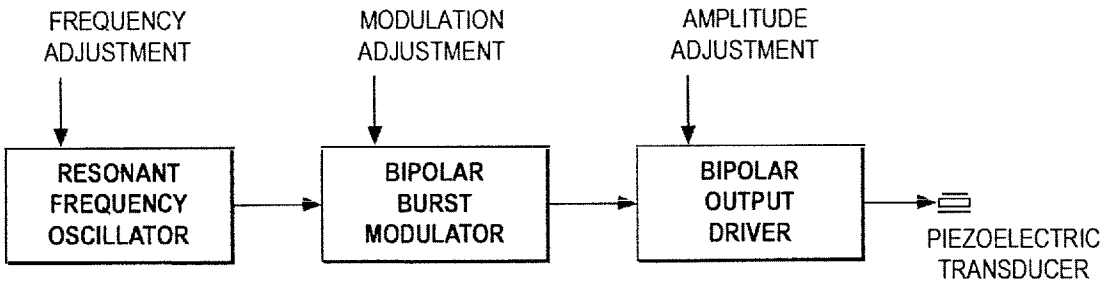
FIG. 9 is a block diagram of a customized modulation.

To deliver power, the driver and power distribution architecture may use a slip-ring, a rotary electrical joint, a collector or an electric swivel. The slip ring keeps continuous connections with the high frequency mesh transducers 100 that are part of the hollow rotary tumbler drum 108 as shown in FIG. 7. The power delivered through the slip ring sources individual high frequency mesh transducer drivers. The individual high frequency mesh transducer drivers provide substantially uniform operation despite the distinctive operating responses of each of high frequency mesh transducers 100. The resonant frequency spread of the high frequency mesh transducers 100 are minimized by this individualized automated control. Due to the reduction in water content during the drying process and differing fabric densities in a single load, a wide variation of loading across a population of high frequency mesh transducers 100 can cause radical shifts in the high frequency mesh transducer 100 resonance that is compensated by the individual or pairwise control via the power distribution architecture. The system compensates for a wide and variable spectrum of resonant frequencies at any moment during the drying process via the driver and power distribution architecture that makes up the high frequency generators by monitoring the feedback of the high frequency mesh transducers 100 at the high frequency generator. Each driver-transducer pair is substantially driven to the high frequency mesh transducer 100 resonance (100 Hz to 400 kHz, preferably 130 kHz) even under load that may render the form of the modulation shown in FIG. 6 and bursts shown in FIG. 8. This means that power delivery to the high frequency mesh transducers 100 is not uniform but varies with the tolerances of each of the high frequency mesh transducers 100 and the current drying conditions.

Figure 10A:
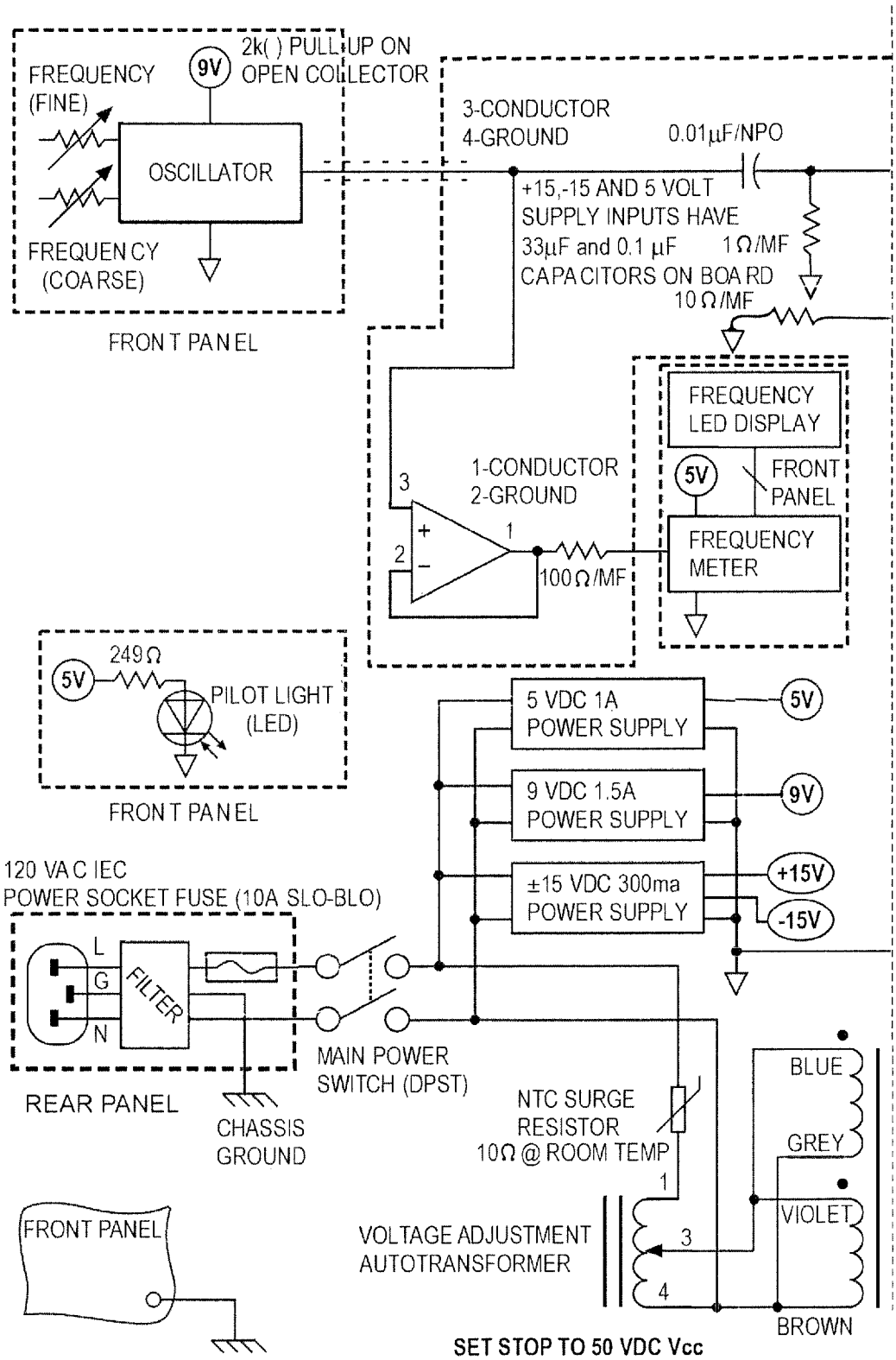
FIGS. 10A and 10B shows piezoelectric mesh transducer drivers.
Figure 10B:
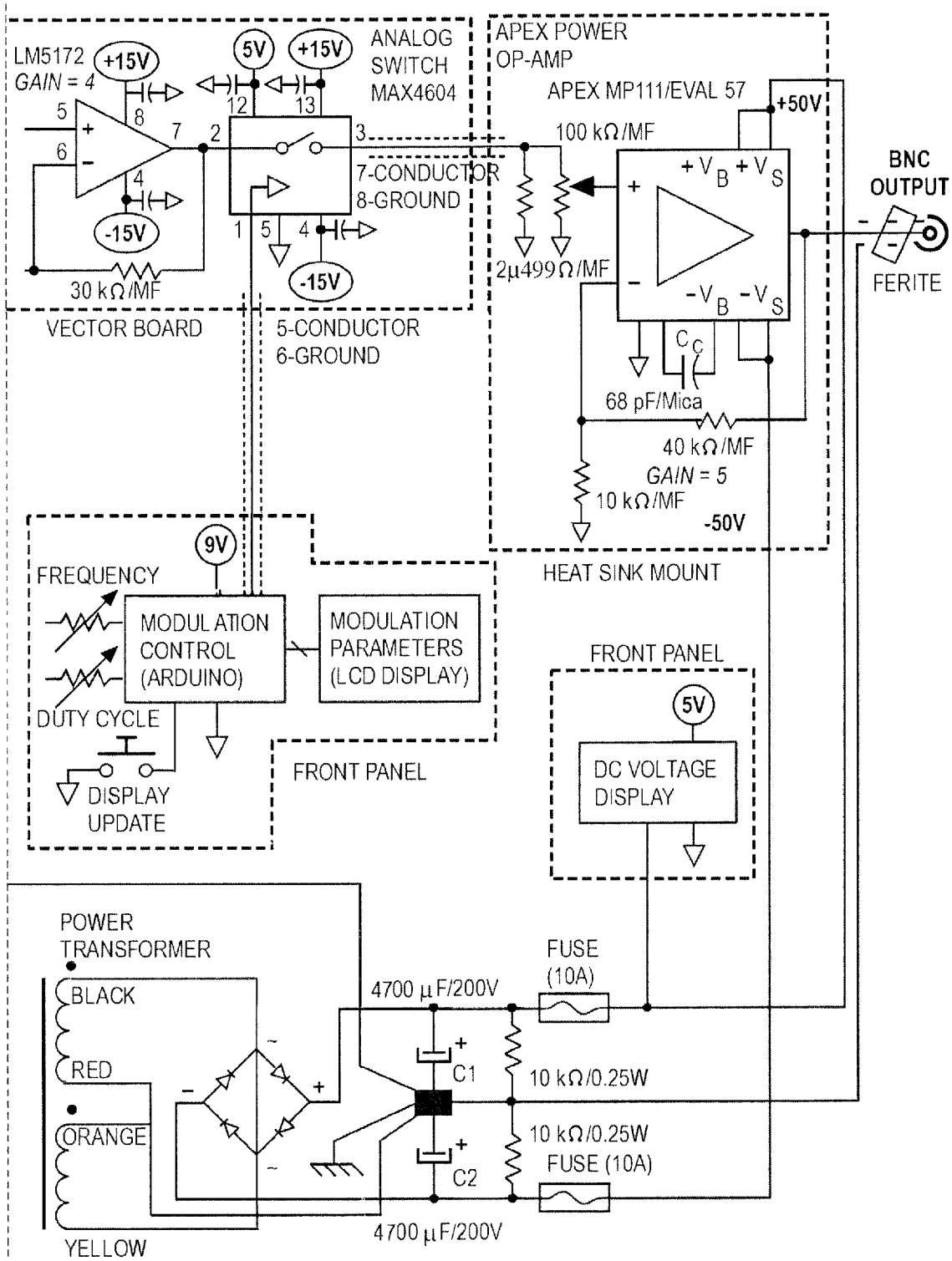

FIGS. 10A and 10B show the high frequency generator functionality and the modulated amplification of the signal sourcing the high frequency mesh transducers 100. In FIG. 10A, the resonant frequency oscillator is automatically adjusted to the resonant frequency during the drying process by one or more controllers, one or more microprocessors (CPUs), one or more signal processors (SPU), and one or more graphics processors (GPUs), monitoring the output of the high frequency mesh transducers 100. The resonant frequency oscillator generates a square wave that is modulated by the modulation adjustment signal. The mixing of the square wave and modulation signal (e.g., multiplier) generates a burst output that drives the high frequency mesh transducers 100 at the resting and active state. When bipolar drivers drive the high frequency mesh transducers 100, the bipolar output is amplified via an amplifier to the operating voltage of the high frequency mesh transducers 100. In some circuits a variable transformer is used to adjust the DC power rail of the desired peak output voltage.

Figure 11:
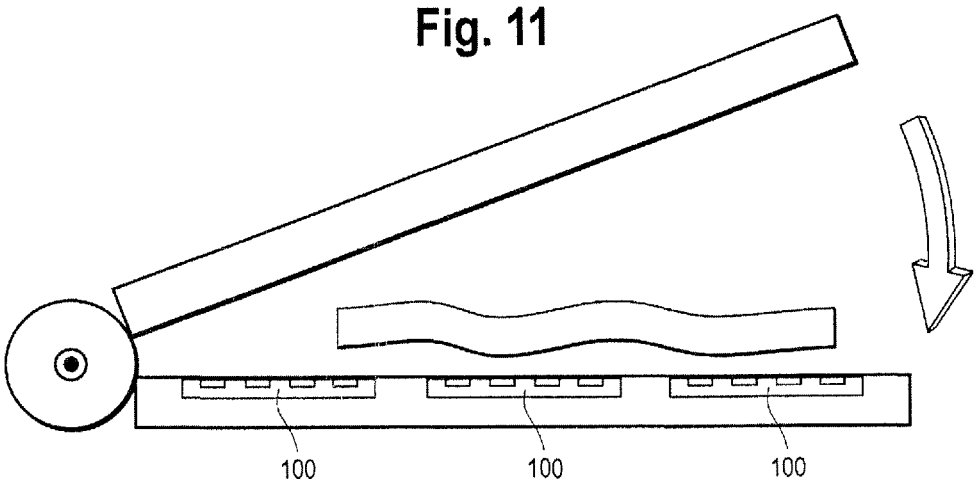
FIG. 11 is a sandwich press/iron dryer/ironing machine.

FIG. 11 shows the high frequency system within a sandwich press/iron. The high frequency mesh transducers 100 are a unitary part of the base of the press. The base is the structure that supports the other elements of the sandwich press/iron is supported and mounted. In use, as wet article such as a fabric is placed on the upper most surface of the base such that it overlies the high frequency mesh transducers 100. A lid composed of both rigid and compressive material conforms to the irregular shape of the article. In some systems a heating element is integrated into the lower surface of the top lid to warm the article after the drying process ends. As the lid is closed, the high frequency mesh transducers 100 are activated; moisture is radially ejected through the high frequency mesh transducers 100 toward the bottom of the sandwich press/iron in response to the control of the high frequency generator.

Figure 12:
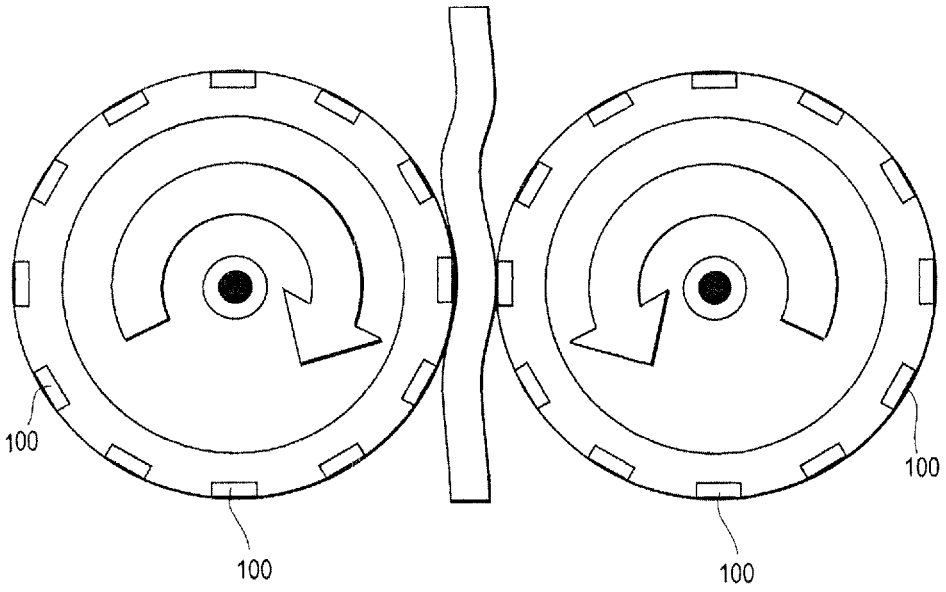
FIG. 12 is wringer high frequency dryer.

FIG. 12 shows a wringer high frequency dryer. The high frequency dryer includes two rotating tumblers, which have high frequency mesh transducers 100 (two are labeled) integrated within them. As the wet fabric is passed through the gap between the tumblers, it comes into contact with the high frequency mesh transducers 100 and moisture is removed. The tumblers are multifunctional as they hold articles such as clothes and further mechanically extract water by feeding articles between the top rotary tumbler and the bottom rotary tumbler. The top and bottom rotary tumblers roll smoothly when the rotary tumblers are manually or automatically driven. When the rotary tumblers are engaged (rotating), the high frequency mesh transducers 100 in contact with the article are activated; moisture is then ejected radially inward in response to the control of the high frequency generator. In some examples two or more pairs of rotating tumblers are arranged in series.

Figure 14:
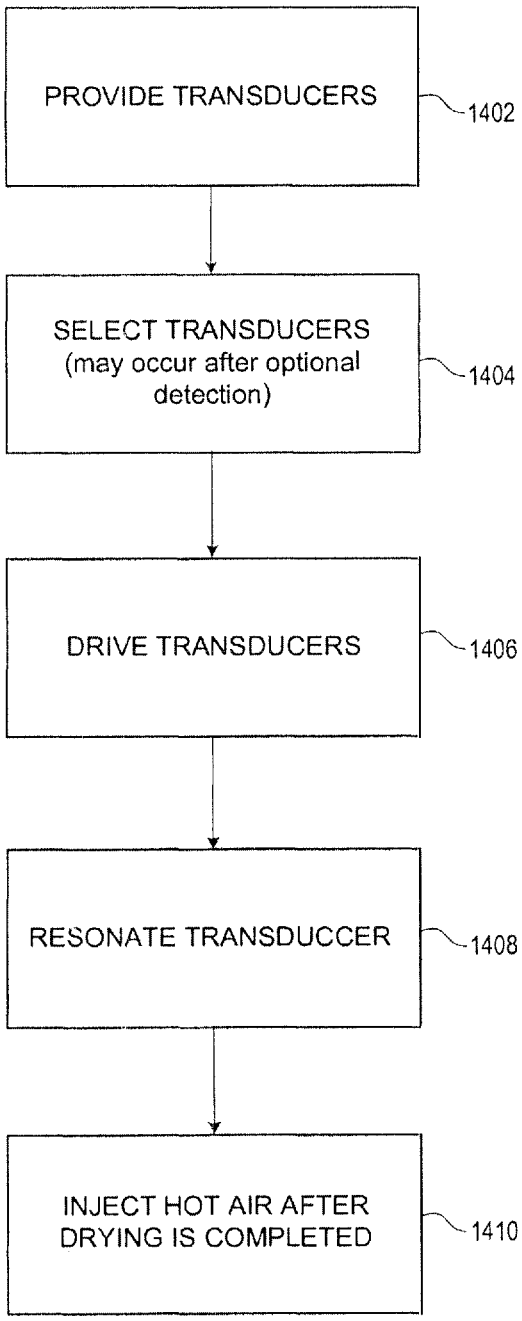
FIG. 14 is an exemplary method of drying a wet article.

FIG. 14 shows a method for drying a wet article. The method may be, for example, implemented using any of the systems described with respect to FIGS. 1-12. The systems may provide two or more piezoelectric (high frequency mesh) transducers 100 having one or more resonant frequencies that are driven by one or more amplifiers or one or more high frequency generators at 1402. The method detects and selects the piezoelectric transducers in contact with the article at 1404; sources an electric signal that drives selected piezoelectric transducers to dry the wet article(s) without circulating heated air at 1406; and resonates the selected piezoelectric (high frequency mesh) transducers non-continuously at their respective resonant frequencies only when the selected piezoelectric (high frequency mesh) transducers are in direct contact with the wet article at 1408. Alternatively, or optionally, the method also injects hot air into the enclosure drying the wet articles after the wet article is substantially dry at optional 1410.

Figure 13:
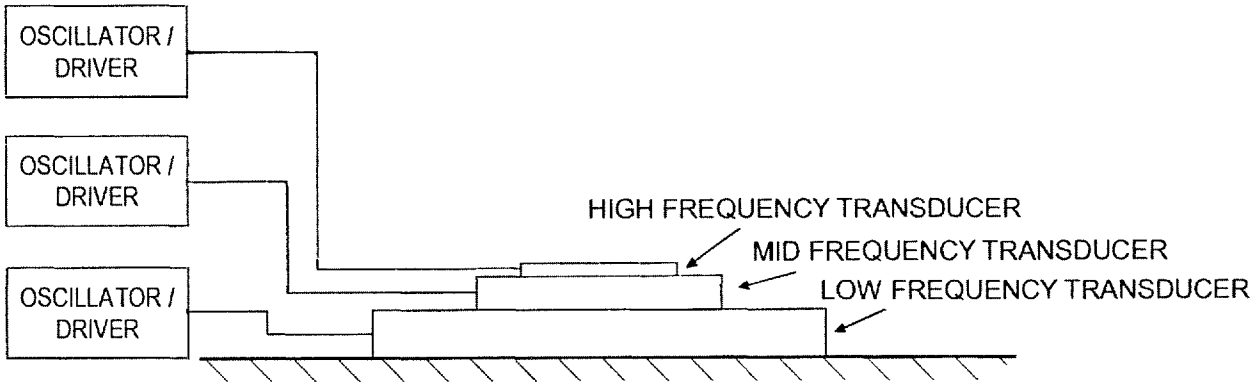
FIG. 13 is a multi-stack of transducers that apply simultaneous variable frequencies to an article.

While each of the disclosed high frequency technology described may stand alone they also may be encompassed within other systems and applications. Other alternate systems may include any combinations of structure and functions described above or shown in one or more or each of the FIGS. These systems or methods are formed from any combination of structure and function described. The structures and functions may process additional or different high frequency mesh transducers 100 and may be supported by other drying structures than a hollow rotary tumbler drum 108, for example. Other high frequency mesh transducers 100 that may be used for example, may apply several widely different frequency signals to one or more articles to affect the drying process include those that have separately tuned piezoelectric and substrate mediums aligned in a stack as shown in FIG. 13. Different frequency ranges will vary the effects on the drying process. A high-frequency signal will cause cavitation and nebulization of the water entrained in an article such as a fabric. A lower mid frequency signal (relative to the high-frequency signal) acts to drive clusters of water away from the article. An even relative lower frequency signal (relative to the mid-frequency signal) can act to move one section of fabric away from a transducer so that another wetter fabric section can come in contact with the high frequency mesh transducers 100 stack.

Other systems include variations of the spaced apart meshes that comprise a plurality of distinct mechanically actuated grids having penetrations that allow various types and viscosities of liquids to pass there through. Some, all, or combinations of the perforated meshes shown are stacked in the high frequency mesh transducers 100 as described above. The spaced apart holes, slots, random perforations, and radial slots with perforated and/or solid reinforcement bars and all combinations thereof are preferred because various meshes and combinations draw water from various articles more effectively and efficiently than others. The combinations and piezoelectric elements provide means to remove nebulized water droplets from a working side of an article. A working side is the side of the article in direct contact with one of the meshes of a high frequency mesh transducer 100. When part of the mesh transducer is in contact with a wet article, a nebulized liquid flow path is established for continuous liquid removal. When solid transducers are used in other alternative systems a flow path is provided to channel nebulized liquid droplets away from the articles.

In each of the systems described meshes are excited by the piezoelectric-medium fixed to a substrate. When powered, the contraction and expansion of the piezoelectric-medium subjects the substrate into bending vibrations. The bending of the substrate excites the mesh vibrations substantially perpendicular to the piezoelectric-medium vibrations. In these systems, the piezoelectric medium and substrate is optimized to a vibration frequency of about 100 Hz to about 400 kHz, preferably 130 kHz and its shape is matched to the deflection shape of the substrate. To ensure the irradiation fluid passes through the high frequency mesh transducers 100, the piezoelectric medium may comprise a piezoelectric-actuator annulus and the substrate may comprise an annulus concentric with the piezoelectric-actuator and coupled at least one mesh along an inner radial portion of the substrate. The meshes are separated preferably by about a one-eighth of an inch open annual O-ring on the upper and lower mesh surface. The mesh surfaces are positioned with the piezoelectric-actuator annulus and the substrate annulus within a hollow right circular cylinder shroud.

All or parts of the high frequency generator may include or be controller by one or more controllers, one or more microprocessors (CPUs), one or more signal processors (SPU), one or more graphics processors (GPUs), one or more application specific integrated circuit (ASIC), one or more programmable media or any and all combinations of such hardware including ultrasonic generators, ultrasonic controllers, ultrasonic microprocessors, ultrasonic SPUs, ultrasonic GPUs, ultrasonic ASICs, etc. All or part of the logic, specialized processes, and systems may be implemented as instructions for execution by multi-core processors (e.g., CPUs, SPUs, and/or GPUs), controller, or other processing device and stored in a tangible or non-transitory machine-readable or computer-readable medium such as flash memory, random access memory (RAM) or read only memory (ROM), erasable programmable read only memory (EPROM) or other machine-readable medium such as a compact disc read only memory (CDROM), or magnetic or optical disk. Thus, a product, such as a computer program product, may include a storage medium and computer readable instructions stored on the medium, which when executed in an endpoint, computer system, or other device, cause the device to perform operations according to any of the process descriptions or hardware descriptions above.

The term "coupled" disclosed in this description may encompass both direct and indirect coupling. Thus, first and second parts are said to be coupled together when they directly contact one another, as well as when the first part couples to an intermediate part which couples either directly or via one or more additional intermediate parts to the second part. The term "substantially" or "about" encompass a range that is largely (ninety five percent or more), but not necessarily wholly, that which is specified. It encompasses all but a significant amount. When devices are responsive to or occur in response to commands events, and/or requests, the actions and/or steps of the devices, such as the operations that devices are performing, necessarily occur as a direct or indirect result of the preceding commands, events, actions, and/or requests. In other words, the operations occur as a result of the preceding operations. A device that is responsive to another requires more than an action (i.e., the device's response to) merely follow another action.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

The claims are as follows:

1. A dryer, comprising:

a piezoelectric oscillation generator;

a substantially hollow rotary tumbler drum for drying wet articles; and a plurality of piezoelectric transducers disposed proximate the substantially hollow rotary tumbler drum in electrical communication with the piezoelectric oscillation generator;

where the piezoelectric oscillation controls a duty cycle and resonant frequency source signal that drive the plurality of piezoelectric transducers that dry the wet articles without heating a portion of air that passes through the articles.

2. The dryer of claim 1 where the plurality of piezoelectric transducers comprises a plurality of piezoelectric mesh transducers.

3. The dryer of claim 2 where the plurality of piezoelectric mesh transducers includes a plurality of separately spaced apart adjacent meshes that comprise a plurality of distinct mechanically actuated grids.

4. The dryer of claim 1 where the plurality of piezoelectric transducers is unitary with the substantially hollow rotary tumbler drum.

5. The dryer of claim 1 where a piezoelectric oscillation is programmed to actuate selected piezoelectric transducers only when an article is in direct contact with the selected piezoelectric transducer.

6. The dryer of claim 5 where the piezoelectric oscillation generator makes a selection in response to a detection of an alert signal transported via an electrical bus.

7. The dryer of claim 6 where the piezoelectric oscillation generator makes the selection in response to a rotational rate of the substantially hollow rotary tumbler drum.

8. The dryer of claim 7 where the piezoelectric oscillation generator actuates selected piezoelectric transducers through a non-continuous burst-width modulated signal.

9. The dryer of claim 7 where the plurality of piezoelectric transducers are unitary part of the substantially hollow rotary tumbler drum.

10. The dryer of claim 7 where the plurality of piezoelectric transducers is disposed adjacent to a lint filter collect a lint discarded from the article.

11. The dryer of claim 7 where the dryer comprises a ventless dryer.

12. The dryer of claim 7 where the dryer comprises a vented dryer.

13. The dryer of claim 1 where substantially all of a drying occurs only when the wet articles are in direct contact with the plurality of piezoelectric transducers.

14. The dryer of claim 1 where the piezoelectric oscillation generator comprises a resonant frequency oscillator in electrical communication with a burst modulator in electrical communication with an output driver.

15. The dryer of claim 1 where the plurality of piezoelectric transducers includes a multi-stack transducer having a plurality of piezoelectric elements driven by different oscillator drivers.

16. The dryer of claim 1 where a plurality of piezoelectric elements each vibrate at different resonant frequencies.

17. The dryer of claim 1 where the piezoelectric oscillation generator drives the plurality of piezoelectric transducer non-continuously.

18. The dryer of claim 1 further comprising separate ultrasonic mesh transducer drivers that drive one of the plurality of piezoelectric transducers.

19. A method of drying a wet article comprising the acts of:

providing a plurality of piezoelectric transducers having a plurality of resonant frequencies electrically coupled to an amplifier;

selecting the piezoelectric transducers in direct contact with the article;

sourcing an electric signal to the selected piezoelectric transducers to dry the wet article without injecting heated air; and resonating the selected piezoelectric transducers at their respective resonant frequencies by providing power tuned to the piezoelectric transducers non-continuously only when a selected number of the plurality of piezoelectric transducers are in direct contact with the wet article.

20. A method of drying a wet article of claim 19 further comprising injecting hot air into a substantially hollow rotary tumbler drum enclosing the wet article only when the wet articles are substantially dry.

21. The method of claim 19 where the selected number of the plurality of piezoelectric transducers are unitary with a substantially hollow rotary tumbler.

22. The method of claim 19 where the selected number of the plurality of piezoelectric transducers are unitary with a base of a press.

23. The method of claim 19 where the selected number of the plurality of piezoelectric transducers are integrated with two or more rotating tumblers.

* * * * *